United States Patent [19]

Inohara

[11] 4,325,194

[45] Apr. 20, 1982

[54] SPORT SHOE SOLE

[75] Inventor: Masanobu Inohara, Akashi, Japan

[73] Assignee: Asics Corporation, Kobe, Japan

[21] Appl. No.: 174,891

[22] Filed: Aug. 4, 1980

Related U.S. Application Data

[62] Division of Ser. No. 896,477, Apr. 14, 1978, Pat. No. 4,236,326.

[51] Int. Cl.[3] ..... A43B 13/20; A43B 21/28

[52] U.S. Cl. ..... 36/29; 36/3 B; 36/35 B

[58] Field of Search ..... 36/29, 28, 3 R, 3 B, 36/35 B

[56] References Cited

U.S. PATENT DOCUMENTS

| | | | |
|---|---|---|---|
| 1,559,532 | 10/1955 | Smith | 36/28 |
| 1,596,923 | 8/1926 | Cooney | 36/29 |
| 2,100,492 | 11/1937 | Sindler | 36/29 |
| 2,198,338 | 4/1940 | Greider | 36/28 X |
| 2,558,973 | 7/1951 | Meaker | 36/3 R |
| 2,885,797 | 5/1959 | Chrencik | 36/28 X |
| 2,983,056 | 5/1961 | Murawski | 36/29 |
| 2,985,971 | 5/1961 | Murawski | 36/29 |
| 3,253,355 | 5/1966 | Menken | 36/29 |
| 4,043,058 | 8/1977 | Hollister et al. | 36/28 |
| 4,102,061 | 7/1978 | Saaristo | 36/28 |
| 4,128,950 | 12/1978 | Bowerman et al. | 36/28 |

FOREIGN PATENT DOCUMENTS

| | | | |
|---|---|---|---|
| 2460034 | 6/1976 | Fed. Rep. of Germany | 36/29 |
| 44-28541 | 11/1969 | Japan . | |
| 45-22691 | 9/1970 | Japan . | |
| 51-18032 | 5/1976 | Japan . | |
| 138794 | 2/1920 | United Kingdom | 36/29 |

*Primary Examiner*—James Kee Chi

[57] ABSTRACT

A sport shoe sole having a ground sole rigid and of excellent abrasion resistance and an elastic interlayer body bonded to the ground sole, in which the interlayer body is provided at its heel portion with an air inclusion means such as grooves and apertures that open at least to one side of the interlayer body.

5 Claims, 13 Drawing Figures

SPORT SHOE SOLE

RELATED APPLICATION

Figure 1:
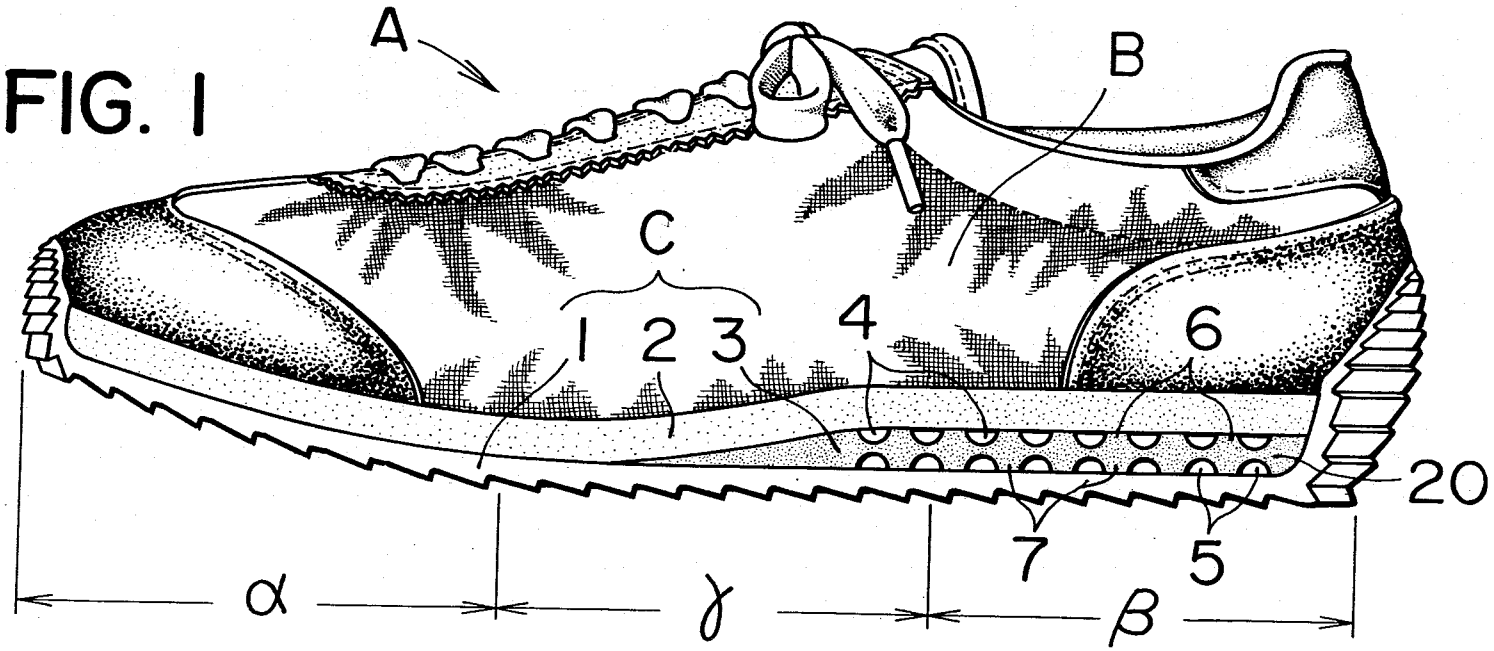

This application is a division of U.S. patent application Ser. No. 896,477, filed Apr. 14, 1978, now U.S. Pat No. 4,236,326.

BACKGROUND OF THE INVENTION

This invention relates to an improvement in the soles of sport shoes suitable for use in track races (such as short-, medium- and long-distance races) and marathon races, as well as in the training therefor.

In the track and marathon races or the training therefor, moving actions of a runner exert an extremely great load on the sole, in particular at the heel portion, of shoes that he wears. It is generally considered that a load three times as much as the body weight of a runner (shoes wearer) is exerted on the heel of the sole upon running movement and, in jumping movement, the load applied on the heel at the shoe sole amounts to about 5–6 times as much as the body weight of a jumper.

Conventional sport shoes for such racing and training uses have a sole comprising a sponge rubber elastic body. Such a sole is, for example, entirely formed with a sponge rubber elastic body of one or more layers, or composed of three layers of sponge rubber whose interlayer sole is formed at its heel with a space in which air is confined tightly.

The former sole is, however, defective since sponge rubber having a sufficient elasticity and durability to withstand the foregoing large load can not easily be available. The latter sole having an air inclusion layer for tightly confining air therein in the heel of the interlayer sole also has a defect in that while a resilience capable of withstanding the foregoing load can be attained due to the resilience of air in the air inclusion layer in addition to the elasticity of the sponge rubber per se, the air present in the air inclusion layer destructs its surrounding wall thereby damaging the interlayer sole upon repeated exertion of the load on the sole during use.

SUMMARY OF THE INVENTION

The object of this invention is accordingly to endow sport shoes soles with resilience of an elastic body per se and that of air in the air inclusion portion causing no such destruction, in order to overcome the defects experienced so far in the sport shoes, in particular, in their shoe soles.

Another object of this invention is to provide shoe soles capable of moderating and withstanding for a long time the impaction load exerted on the shoe sole primarily in its heel (amounting to about 3–6 times as high as the body weight of a racer) resulted by the moving actions of the racer, by utilizing a synergistic effect between the resilience of the elastic body per se and that of air sealed in the air inclusion portion which will cause no destruction, and thereby effectively attaining the running effect of the racer.

Other objects, features and attending advantages of this invention will become more apparent from the following detailed description with reference to the accompanying drawings.

These and other objects have been attained by an interlayer body of this invention made of an elastic body and put between a ground sole constituting the portion of the sole that directly contacts the ground and a shoe upper and comprising, at least on its heel, an air inclusion means which opens at least to one side of the elastic body.

BRIEF DESCRIPTION OF ACCOMPANYING DRAWINGS

This invention is to be described in more detail referring to the accompanying drawings which illustrate preferred embodiments of this invention. It will of course be apparent that the scope claimed by this invention is no way limited only to these embodiments.

FIG. 1 is a right side view of a shoe in which a shoe sole according to this invention is bonded to a shoe upper.

Figure 11:
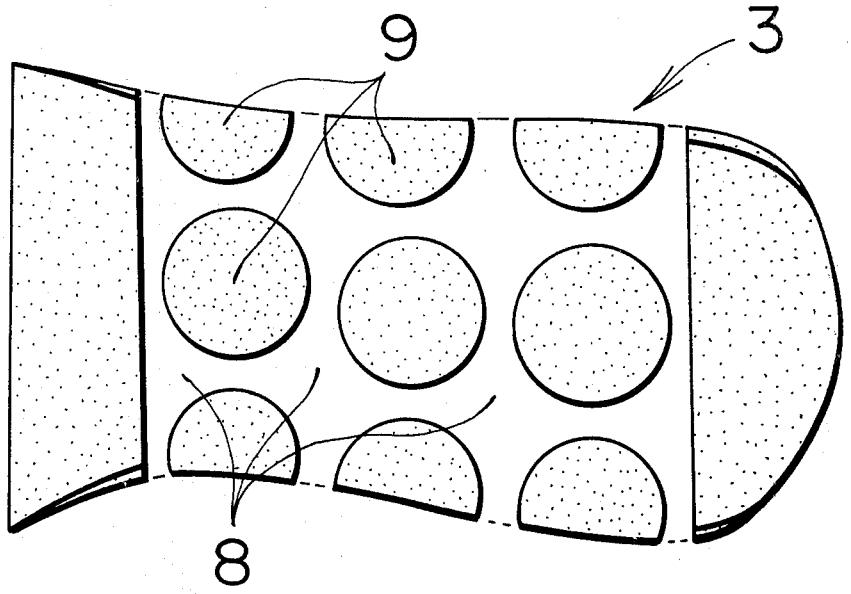
Figure 12:
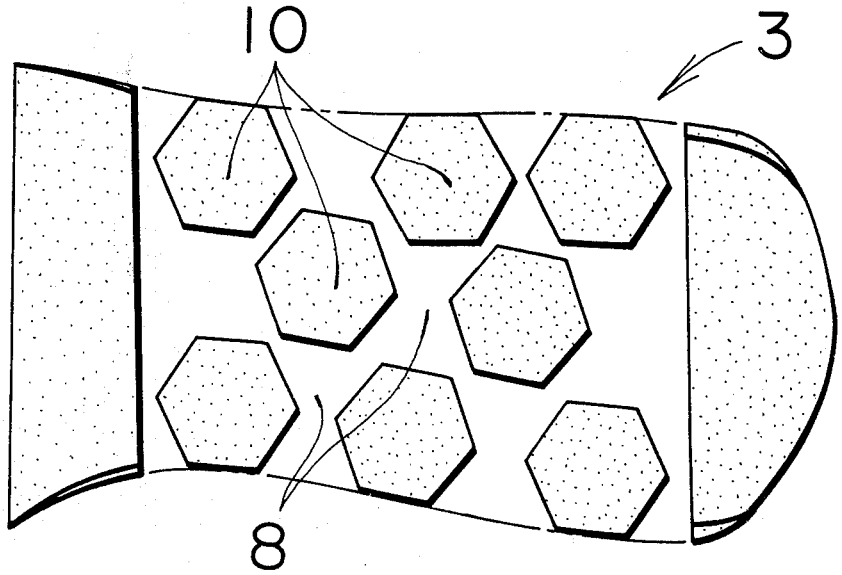
Figure 13:
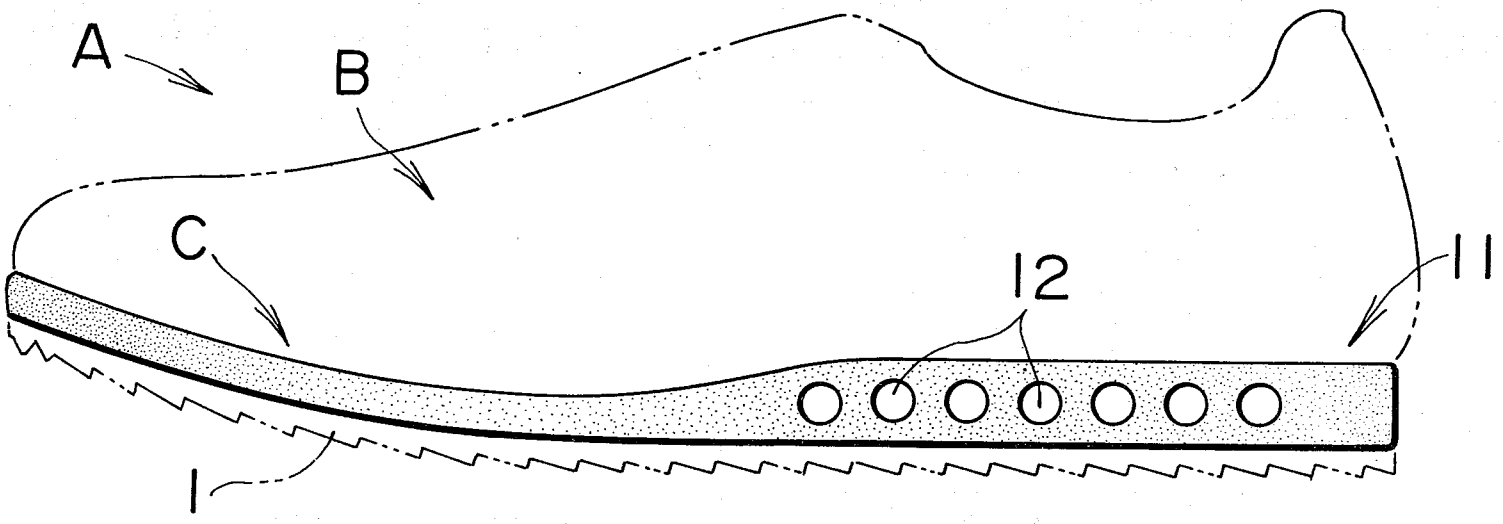

FIG. 2 to FIG. 13 respectively show various preferred embodiments of the interlayer body to be used in the shoe sole of this invention, in which FIG. 2 to FIG. 7 respectively show side views of the interlayer body for each of the embodiments and FIG. 8 to FIG. 12 respectively show plan views of the interlayer body for each of the embodiments; and FIG. 13 is a side view of an interlayer body which also serves as an interlayer sole.

PREFERRED EMBODIMENTS

In FIG. 1, a sport shoe A comprises, in structure, a shoe upper B and a shoe sole C which is bonded by way of adhesives to the lower surface of the shoe upper B and consists, at its sole, of a toe portion $\alpha$, a heel portion $\beta$ and an arch portion $\gamma$. The shoe sole C of this invention comprises a ground sole 1, an interlayer sole 2 bonded at its upper surface to the shoe upper A and bonded at the toe of its lower surface to the above ground sole 1, and an interlayer body 3 situated at the heel portion $\beta$ of the shoe A and put between the above ground sole 1 and the interlayer sole 2.

The shoe sole C is made of rubbery material in which the ground sole 1 at the lowermost layer consists of rigid rubber or polyurethane, and the interlayer sole 2 and the interlayer body 3 consist of soft rubber, polyurethane, sponge and the like. The shoe sole C can also be formed with other materials selected from those conventionally employed as the sole materials for sport shoes in the relevant field of the art. The materials for the ground sole 1 should be selected from the materials more rigid and abrasion resistant than those for the interlayer body 3. The materials for the interlayer sole 2 and the interlayer body 3 may be identical or different. The interlayer sole 2 is desirably elastic and, in particular, a sufficient resilience is required for the interlayer body 3 to serve as an elastic body.

Presence of the interlayer sole 2 of the shoe sole C is not essential in this invention and the sport shoe A can alternatively be constituted by bonding the interlayer body 3 to the ground sole 1 to form the shoe sole C and by directly bonding the same to the shoe upper B.

The interlayer body 3 as the elastic body shown in FIG. 1 is formed in a generally uniform thickness at the area situating on the heel and gradually reduces its thickness into a wedge form, at least in the arch portion, toward the top of that portion. More specifically, the interlayer body 3 has such a shape as its upper surface gradually lowers from the heel to the top of the arch to thereby decrease its thickness gradually. While the thickness of the interlayer body 3 at the heel may not always be uniform and it may either be smaller or greater as compared with that of the interlayer sole 2, it is desired that the thickness of the interlayer body 3 and that of the interlayer sole 2 are identical. The shoe sole C is designed in such a configuration as well-conforming the shape of a runner's foot and suiting to running movements.

Figure 8:
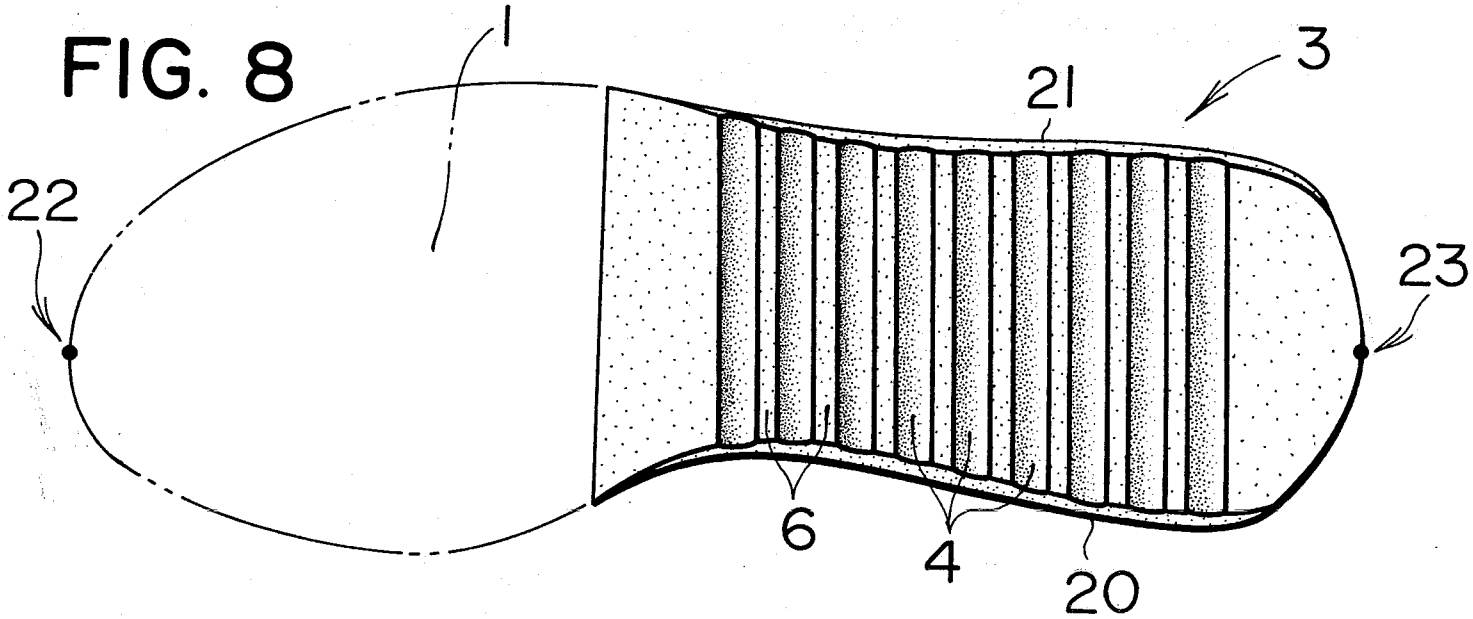

A plurality of air inclusion grooves 4 and 5 as an air inclusion means of this invention are formed at the upper and the lower surfaces of the interlayer body 3 respectively. Each of the grooves 4 and 5 opens at least to one side of the interlayer body 3 and has a semi-circular shape in the side view (that is, in cross section) and a linear shape in the plan view as shown in FIG. 8.

The side of the shoe sole of this invention referred to herein is defined as showing each of the right and the left peripheral faces of the shoe sole obtained by dividing the shoe sole with a line connecting the top end of the toe and the rear end of the heel. Namely, right and left peripheral faces 20 and 21 formed by dividing the sole with a line connecting the points 22 and 23 in FIG. 8 constitute the both sides of the shoe sole.

The grooves 4 and 5 are arranged at the positions alternating to each other and the projections 6,7 between the grooves are bonded respectively to the interlayer sole 2 and the ground sole 1 by way of adhesives. The grooves 4 and 5 form air inclusion portions for including air between the interlayer body 3 and the interlayer sole 2 and between the interlayer body 3 and the ground sole 1. The air inclusion portions of this invention are different from the foregoing air inclusion layer of conventional shoes in which air is tightly confined and communicate to the external atmosphere. Namely, the air inclusion portions open externally at each of the sides 20 and 21 of the interlayer body 3.

Thus, air from the outside of the sole is always present in each of the grooves 4 and 5 formed in the interlayer body 3, which provides an air resilience cooperating with the sponge resilience obtained from the interlayer sole 2 and the interlayer body 3. The synergistic effect between the sponge resilience and the air resilience can moderate the rebounding resilience acted upon from the surface of the ground and the like against the landing pressure resulted by the moving action of a racer, which amounts 3 to 6 times as much as the body weight of the racer. Since the air included in each of the above grooves 4 and 5 are released externally upon compression of the interlayer body 3, no destruction occurs as in a closed type air inclusion layer in the sole of conventional sport shoes. Each of the grooves 4 and 5 of the interlayer body 3 from which air has once been released is re-filled with air spontaneously. Repeating exhaustion and re-filling of air from and into the grooves enable to attain the intended purpose of moderating the compression load with long lasting effect. Moreover, since the weight of the wedged shoe sole 3 is reduced by so much as forming the grooves 4 and 5, the most important requirement for the sport shoes, that is, weight reduction can be attained as well.

Figure 2:
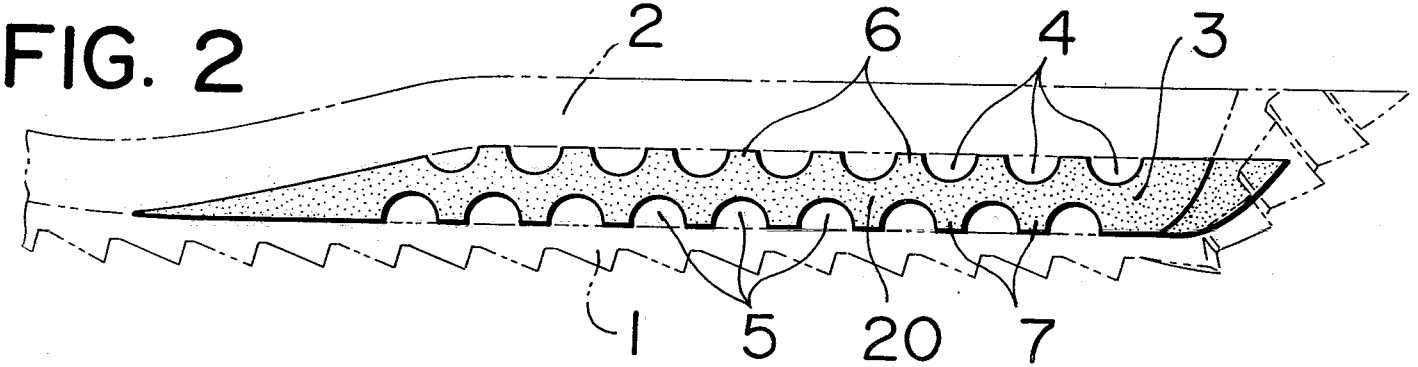
Figure 3:
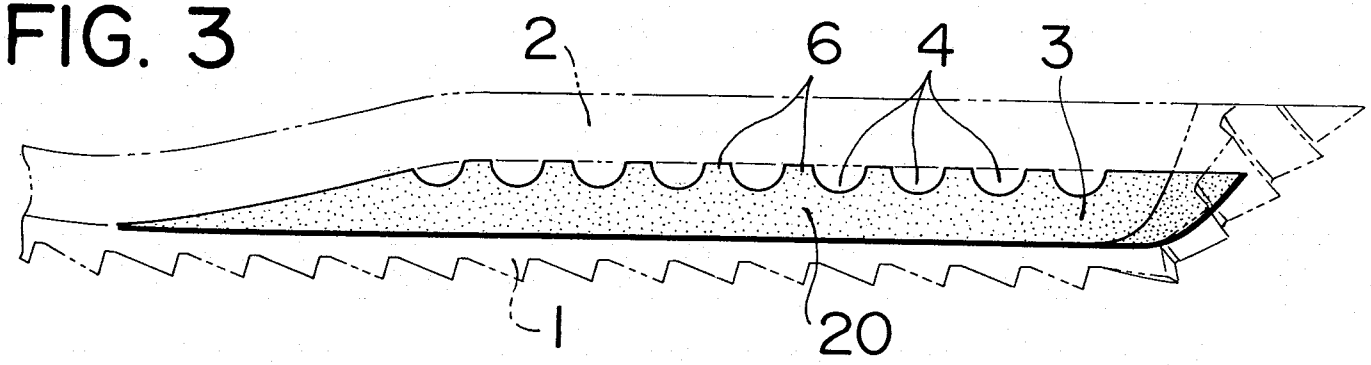
Figure 4:
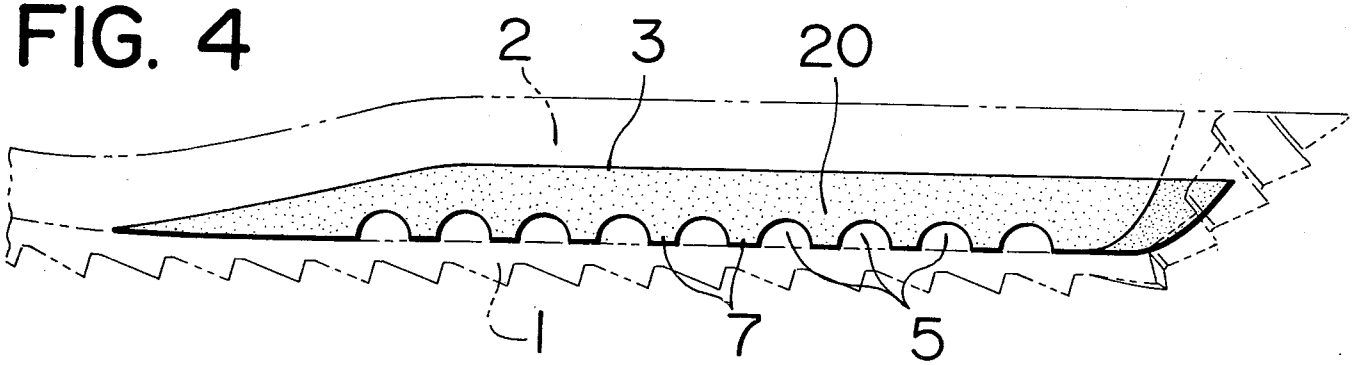
Figure 5:
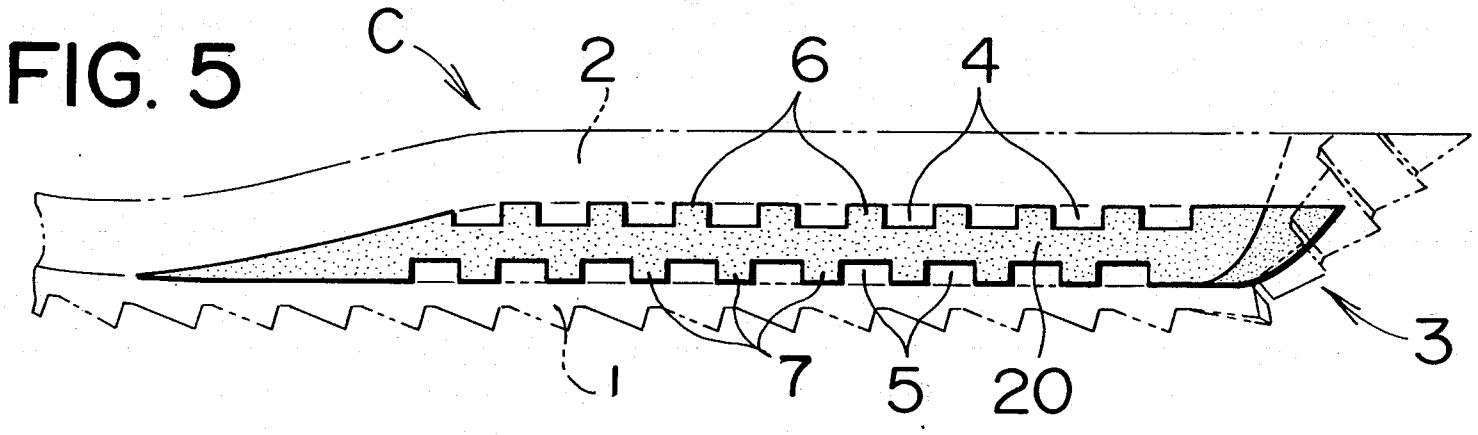

The air inclusion grooves to be formed in the interlayer body 3 can be constituted, for example, as shown in FIG. 2 in which the grooves 4 and 5 are displaced laterally from each other, as shown in FIG. 3 in which only the grooves 4 are formed or as shown in FIG. 4 in which only the grooves 5 are formed. The side (cross sectional) shape of the grooves 4 and 5 may not restricted only to the semi-circular shape but can be formed in generally full circular shape or, as shown in FIG. 5, in a square shape.

Figure 9:
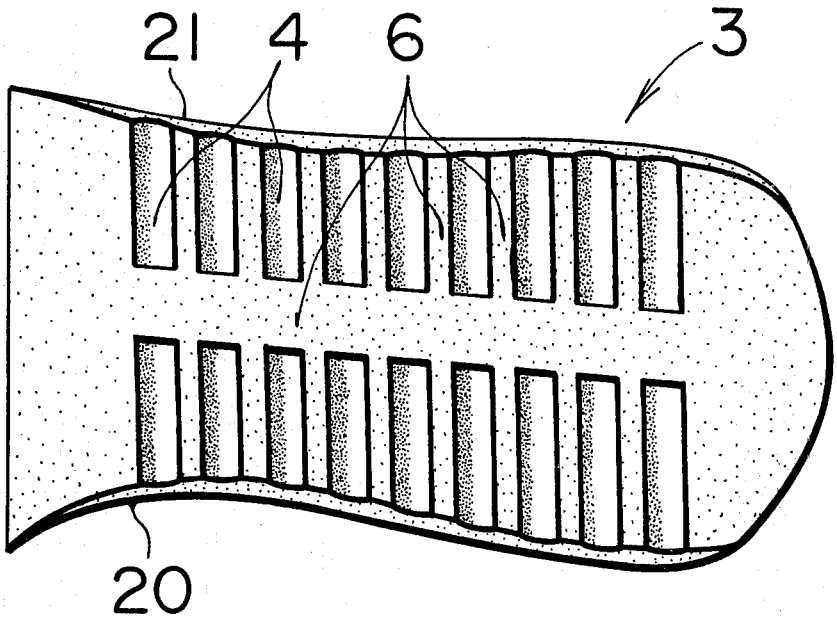
Figure 10:
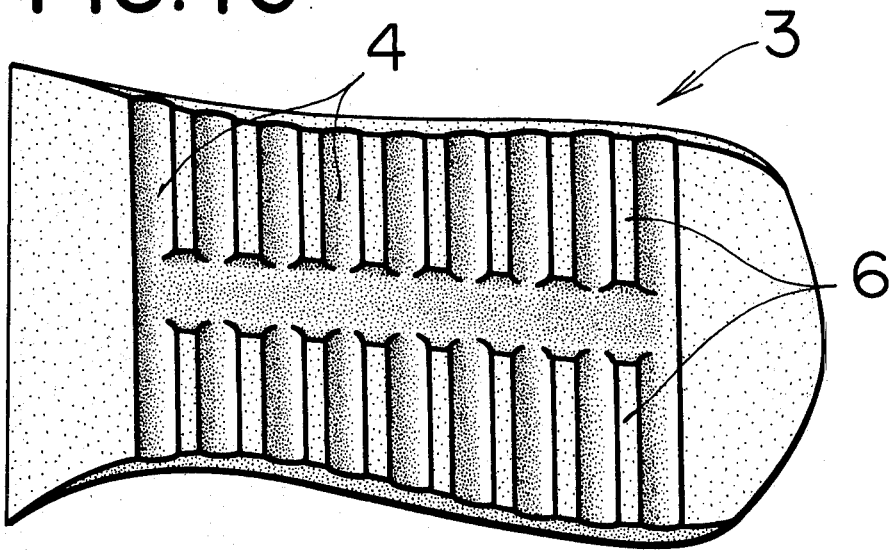

Various shapes, in plan, are applicable to the air inclusion grooves 4 and 5 of the interlayer body 3 in addition to the shape of through grooves extended to both side ends 20 and 21 of the interlayer body 3 as shown in FIG. 8 and they include those grooves extended from each of the sides 20 and 21 of the interlayer body 3 before the center thereof, that is, the grooves disconnected at the center of the interlayer body 3 as shown in FIG. 9, as well as those grooves communicating to each other at the center of the interlayer body 3 as shown in FIG. 10.

It is thus necessary for the air inclusion grooves in the interlayer body 3 to communicate and open externally while leaving sufficient projection between the grooves to support the load which amounts to 3 or 6 times as much as the body weight of the racer.

Figure 6:
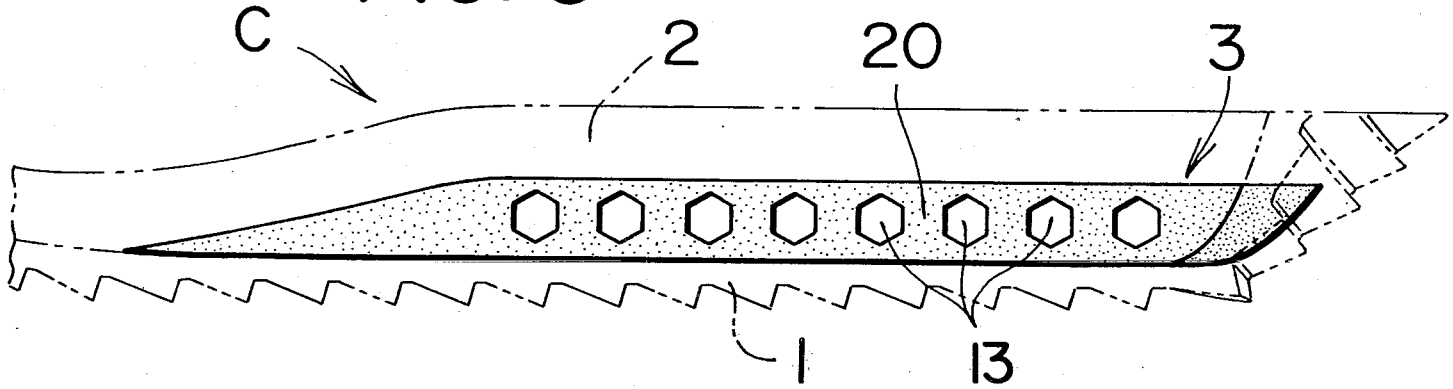
Figure 7:
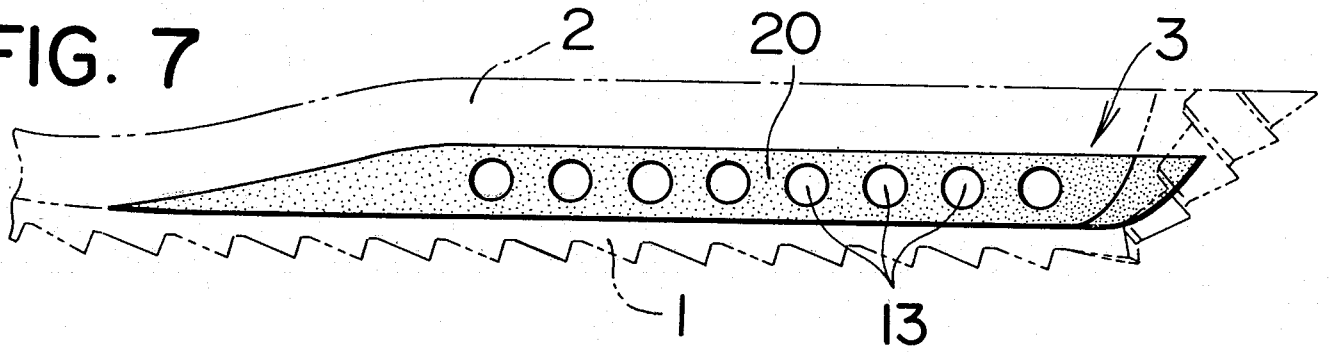

FIG. 6 and FIG. 7 show embodiments in which a plurality of apertures 13 are formed between the upper and the lower surfaces of the interlayer body 3 as the air inclusion means. The apertures 13, like the grooves 4, open at least to one side 20 and 21 of the interlayer body 3 and formed in parallel with the upper or the lower surface of the interlayer body 3.

These apertures 13 can be formed like the grooves shown in FIG. 8 as through holes passing between both sides 20 and 21 of the interlayer body, like the grooves shown in FIG. 9 as the holes disconnected at the center of the interlayer body or like the grooves 4 shown in FIG. 10 in which the grooves 4 communicate to each other at the center of the interlayer body. The apertures may be formed in various sections such as a hexagonal shape as shown in FIG. 6 or other polygonal shapes and a circular shape as shown in FIG. 7.

Other embodiments of the interlayer body 3 are shown in FIGS. 11 and 12. The air inclusion means provided to the interlayer body 3 is, as shown in FIGS. 11 and 12, in the form of honeycomb shape provided with groove. In the interlayer body 3 shown in FIG. 11, arrangement of the groove 8 and the projections 9 is reversed to that of the closed type air inclusion layer in the conventional shoes. Specifically, closed circular air inclusion portions in the conventional shoes are replaced with circular projections 9 and the projections in the conventional shoes are replaced with groove 8 in this invention, which open to the atmosphere outside of the interlayer body 3.

In the interlayer body 3 shown in FIG. 12, the circular projections 9 of the interlayer body shown in FIG. 11 are replaced with hexagonal projections 10 and, as apparent from the foregoings, the projections may not be always be restricted to circular or hexagonal shape but in any other forms.

It will be apparent from the foregoing that the air inclusion means in the interlayer body according to this invention for use with the soles of sports shoes is not restricted to the embodiment shown in FIG. 1 but can take various other shapes. Each type of the interlayer body of this invention shows elastic deformation within such a range as causing no destruction to its air inclusion means when applied with a compression load from a racer upon movement which is about 3 to 6 times as much as his body weight. The shoe sole having the interlayer body 3 according to this invention can moderate the above compression load effectively by the resilience of the interlayer body per se and the resilience of air which is resulted upon releasing of air from the grooves or the apertures. Air flown out from the grooves or the apertures behaves as a sort of an air bumper to partially absorb and externally release the impact load. The projections between the grooves or the walls between the apertures form a satisfactory load supporting portion which makes the interlayer body as a structure of reduced weight and excellent durability.

Accordingly, the shoe sole of this invention has a satisfactory property for absorbing impact shock applied from the ground and a less resillience to provide a soft rebounding thereby forming soft cushion for allowing to keep a smooth moving trace of a foot during running. Provision of the grooves on the upper and/or the lower surface of the interlayer body reduces the impact receiving area to thereby result in normal cushioning effect.

FIG. 13 shows a further embodiment of the interlayer body integrally formed with interlayer sole 2. An interlayer body 11 has the same shape as the interlayer sole 2, that is, the shape being capable of bonding to the entire lower surface of the shoe upper B and has provided therein a plurality of apertures 12 as in the interlayer body shown in FIG. 7. The apertures 12 have a circulare section and pass between both sides ends 20 and 21 of the interlayer body. The apertures may of course be constituted, like the apertures 7 in the interlayer body shown in FIG. 7, as apertures extended before the center of the interlayer body or as the apertures communicated to each other at the center. The apertures may be in a polygonal cross section instead of the circular section. The apertures may not always be formed between the upper and the lower surfaces of the interlayer body, but it can be formed to the lower surface as the grooves 5 shown in FIG. 4.

The interlayer body 11 shown in FIG. 13 also serves as an interlayer sole 2 and the shoe sole C is constituted with the interlayer body 11 and the ground sole 1, and the shoe A is constituted by bonding the shoe upper B to the upper surface of the interlayer.

The interlayer body 11 can simplify the production step for the shoe sole C as compared with each of the interlayer bodies described before while providing same effects.

What is claimed is:

1. A sole for use with sport shoes comprising a rigid abrasion-resistant ground sole, the ground sole having a heel portion, an arch portion, and a toe portion, a resilient and elastic interlayer body bonded to said ground sole, and a resilient and elastic interlayer sole bonded to said interlayer body, said interlayer body being extended over and bonded to the heel portion and the shoe arch portion of the ground sole and having uniform thickness at the heel portion and decreasing into a wedge shape toward the top of the shoe arch portion, the interlayer body being provided with a plurality of parallel, transversely extending grooves on the surface of said interlayer body from its one side to its opposite side, each groove communicating to each other at the center of the interlayer body, the cross section of each groove being semi-circular so as to have uniform distribution of stress, preferred absorbing power of impact load, and a durable shape, the resilience of the interlayer body and the interlayer sole and the air in the grooves permitting preferred absorption of impact load exerted against the heel portion of the sole at the time of landing and good restoration and long durability of arched shapes.

2. The sole as claimed in claim 1, wherein the grooves are provided only on the upper surface of the interlayer body.

3. The sole as claimed in claim 1, wherein the grooves are provided only on the lower surface of the interlayer body.

4. The sole as claimed in claim 1, wherein the grooves are provided both on the upper and lower surfaces of the interlayer body.

5. A sole for use with sport shoes comprising a rigid abrasion-resistant ground sole, the ground sole having a heel portion, an arch portion, and a toe portion, a resilient and elastic interlayer body bonded to said ground sole, and a resilient and elastic interlayer sole bonded to said interlayer body, said interlayer body being extended over and bonded to the heel portion and the shoe arch portion of the ground sole and having uniform thickness at the heel portion and decreasing into a wedge shape toward the top of the shoe arch portion, the interlayer body being provided with a plurality of parallel, transversely extending grooves on the surface of said interlayer body from its one side to its opposite side, each groove communicating to each other at the center of the interlayer body, the cross section of each groove being semi-circular.

* * * * *